US005608348A

United States Patent [19]

Kearney et al.

[11] Patent Number: 5,608,348

[45] Date of Patent: Mar. 4, 1997

[54] BINARY PROGRAMMABLE CURRENT MIRROR

[75] Inventors: Mark B. Kearney; Douglas B. Osborn, both of Kokomo, Ind.

[73] Assignee: Delco Electronics Corporation, Kokomo, Ind.

[21] Appl. No.: 651,440

[22] Filed: May 22, 1996

Related U.S. Application Data

[63] Continuation of Ser. No. 421,761, Apr. 14, 1995, abandoned.

[51] Int. Cl.[6] ..... G05F 3/02

[52] U.S. Cl. ..... 327/538; 327/545

[58] Field of Search ..... 327/538, 540, 327/545; 323/313, 315

[56] References Cited

U.S. PATENT DOCUMENTS

| | | | |
|---|---|---|---|
| 4,103,219 | 7/1978 | Wheatley, Jr. | 323/313 |
| 4,118,699 | 10/1978 | Comer | 340/347 |
| 4,361,816 | 11/1982 | Schade, Jr. | 330/288 |
| 4,608,530 | 8/1986 | Bacrania | 323/315 |
| 5,111,204 | 5/1992 | Katzenstein | 341/150 |
| 5,432,389 | 7/1995 | Bader et al. | 327/538 |

*Primary Examiner*—Terry Cunningham
*Attorney, Agent, or Firm*—Jimmy L. Funke

[57] ABSTRACT

A programmable current mirror circuit suitable for incorporation into circuit designs and programmably tailored to produce a ratio of current output over current input based upon the status of a plurality of binary weighted switches. The resulting circuit is readily tailored so as to be insensitive to the "on" characteristics of the switches. Alternatively, the switches may comprise transistors controlled by accompanying circuitry operable to produce an equivalent switching function. An input current divider circuit network formed from an array of current mirrors fractionally divides an input current into a plurality of equivalent currents. A binary weighting circuit receives such fractional input currents, and applies a binary weight to each of same. A voltage to current converter receives the binary weighted voltage and converts the voltage to a weighted output current proportional to the input current directly in relation to the binary weighting applied via the binary weighting circuit.

14 Claims, 2 Drawing Sheets

BINARY PROGRAMMABLE CURRENT MIRROR

This is a continuation of application Ser. No. 08/421,761 filed on 14, Apr. 1995, now abandoned.

BACKGROUND OF THE INVENTION

1. Technical Field

This invention relates to electronic circuits, and more particularly to programmable-gain current mirrors.

2. Discussion

Current mirrors are commonly used in integrated circuits as a standard unit, or building block when constructing circuits for a wide variety of applications. A typical current mirror in practice consists of an arrangement of two or more transistors arranged such that a defined current passing into one of the transistors is mirrored into another at a high resistance level so as to form a constant current source. Typically, the output current produced will be equal to some fixed multiple of the input current. Furthermore, when implemented with a pair of bipolar transistors, the pair of transistors will be joined at their base and emitter so as to have identical base-to-emitter voltages. If implemented with MOSFET transistors, the gate and source would typically be joined.

One reason for wide use of current mirrors in integrated circuits is that it is possible to achieve very close matching of the transistors as they are typically arrayed in close proximity on the integrated circuit. Therefore, for many applications the adjacent transistors will have approximately the same temperature, which eliminates thermal variations affecting the current-voltage characteristics of the transistors with respect to temperature.

Furthermore, current mirrors are normally designed to achieve a fixed ratio of input current to output current under conditions where the area ratios of the components, or transistors comprising the current mirror circuit may be precisely controlled. However, in some applications it may be desirable to utilize a current mirror having a variable transfer ratio of input to output current. It is difficult to achieve such a variable transfer ratio using standard linear integrated circuit design techniques since it becomes difficult to construct transistors and resistors having variable area ratios.

One recent attempt to obtain programmable-gain current mirror amplifiers involved an attempt to reduce their tendency to become complex, and resulted in a programmable mirror controlled by binary switches. As a result, the functionality of the circuit trim can be verified ahead of time if the circuit is not sensitive to the "on" resistance of the switches. Using techniques which have been available to-date, such a programmable current mirror requires the use of binary weighted area ratio's on transistors in order to provide programmable currents for use for over a range of operating conditions. Hence, its implementation can not be readily tailored.

Furthermore, the above described method can be very area intensive, requiring a large circuit layout area when implemented on an integrated circuit, if the number of bits of programmability required becomes fairly large. For example, with each additional bit of programmability that is added, it becomes necessary to add another transistor to match the original transistor. This effectively doubles the size necessary for layout on the integrated circuit over the size necessary for the previous bit's transistor. Essentially, each bit of trim requires a transistor two times the previous bit's transistor. Therefore, when adding an additional bit, the size increases proportionally over the size required for the previous bit's transistor. Furthermore, the precision of the matched devices, or transistors also goes down as the number of devices, or transistors needed to be matched goes up. This result is necessary because well matched devices must be located in close proximity on the integrated chip die due to processing variations, package stresses, and temperature variations. Processing variations are variations we see across a wafer due to the variation of that wafer. These variations may include doping concentrations and diffusion depths that can affect the performance of a transistor. Therefore, as the number of bits required goes up, the size of the transistor and its layout area on the integrated circuit gets larger, and relatively close proximity of the transistors on the integrated chip layout is no longer a viable option.

Therefore, there is a need for implementing a programmable current mirror where the ratio of the output current over the input current is variable and is easily controlled by binary switches, and can still be packaged with transistors in relatively close proximity, to provide for better circuit performance over environmental variations, and also allows for a much smaller die size during fabrication. Furthermore, there is a need to programmably vary the above ratio in a manner which is not affected by the circuit operation as a result of the "on" resistance of the binary switches during tailoring of a desired programmed circuit implementation.

SUMMARY OF THE INVENTION

A programmable-gain current mirror suitable for use in linear integrated circuits is operable to produce a ratio of output current to input current which is variable and easily controlled by binary switches, yet is insensitive to the "on" resistance of the switches. The resulting current mirror does not require the use of binary weighted area ratios in any component, thereby facilitating better circuit performance when implementing circuits having a large number of programming bits over environmental variations as a result of implementation on a much smaller integrated circuit (IC) chip. Additionally, a much smaller die size is required. In one described implementation, the current mirror of this invention utilizes four switches which are constructed and arranged to program the transfer ratio $I_{OUT}/I_{IN}$. Of the current mirror. Essentially, a four-bit binary programmable circuit is provided. However, the switching could easily be extended to any reasonable number of bits.

Another object of the invention is to provide an alternative construction current mirror having binary switches formed with transistors controlled by accompanying circuitry. By programming the status of the transistors via the circuitry, the $I_{OUT}/I_{IN}$ transfer ratio can be suitably varied to obtain a tailored condition. The binary programmable current mirror of this invention can be readily implemented with a plurality of switches, or transistor circuits which are insensitive to the "on" resistance of the switches and do not require the use of binary weighted area ratios in any components to produce a variable transfer ratio of input to output current. Similarly, the current mirror is readily implemented with transistors that can be arranged in smaller size packages in combination with resistors so as to obtain component matching. Therefore, the size of the circuit does not increase exponentially as the number of bits go up, but only increases in a linear relation to the increase in the number of bits. This allows for closer proximity placement of components for matching purposes, and therefore results in better circuit performance over certain environmental variations including processing variations, packaging stresses, and temperature variations, and provides a much smaller die size during construction so as to facilitate an integrated chip implementation of the programmable current mirror that is small for a large number of programmable bits, readily implemented on a monolithic chip construction, easily component matched, and is easy and economical to manufacture and assemble.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
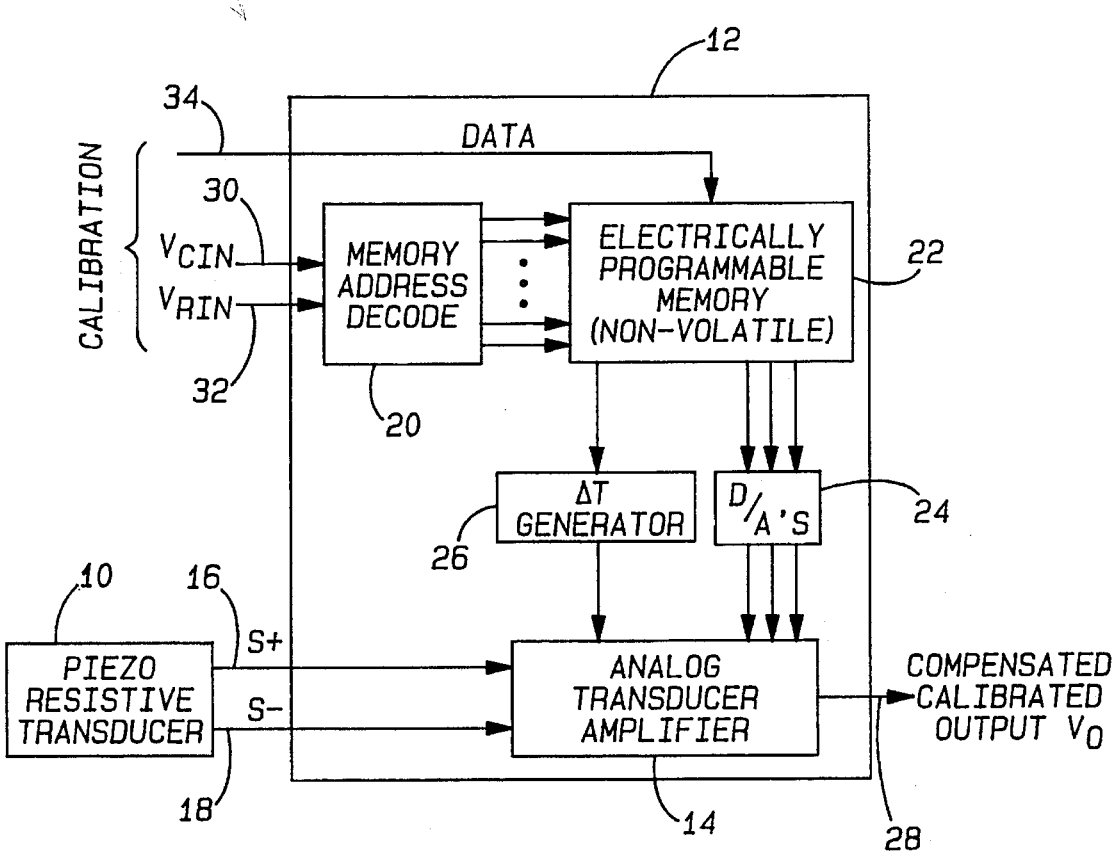
FIG. 1 is a functional block diagram of a digitally calibrated transducer amplifier showing the binary programmable current-mirror circuit of the present invention with a presently preferred implementation.

With reference to the drawings, in FIG. 1, a binary programmable current mirror 24 of this invention is generally depicted as a digital-to-analog (DAC) circuit. In the preferred implementation, current mirror 24 is utilized as a building block, or part of a larger integrated circuit to provide a variable transfer ratio input to output current. However, many alternative implementations could be readily understood by one skilled in the art. For this particular implementation, current mirror 24 is monolithically integrated onto a larger digitally calibrated transducer amplifier 12. Preferably, the entire amplifier 12 is implemented as a single monolithic chip.

The current mirror 24 of this invention provides a suitable transfer ratio input to output signal suitable for integration within the monolithic chip design so as to generate a suitable transfer ratio input to output current that is easily controlled by binary switches, yet is packaged in a small size and is insensitive to the "on" resistance of the switches and does not require the use of binary weighted area ratios in any of its components. In this implementation, an electrically programmable non-volatile memory 22 generates a digital code comprising four binary values which are input to current mirror 24. In operation, the current mirror 24 receives the digital code in order to control the internal binary switches so as to obtain a desired ratio of output current to input current. The output current is then fed to an analog transducer amplifier 14. Furthermore, a memory address decode 20 receives a pair of external voltage inputs in combination with a data delivery input which drives the memory 22. Furthermore, a ΔT generator 26 provides a temperature dependent DC offset voltage to the analog motion sensor amplifier 14. As a result, a voltage output $V_0$ is produced having suitable characteristics which are compensated and calibrated at output 28.

Figure 2:
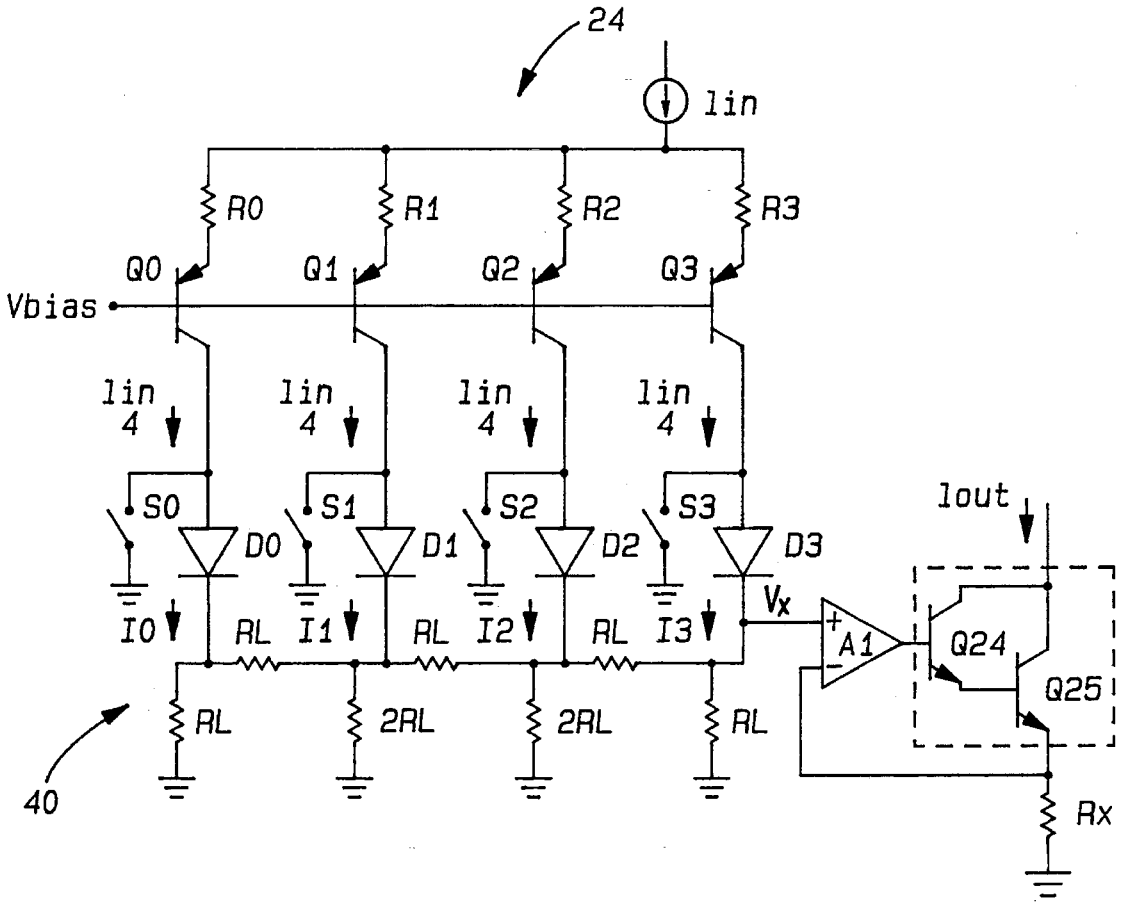
FIG. 2 is an electrical schematic diagram of the binary programmable current mirror circuit illustrated functionally in FIG. 1.

Referring to FIG. 2, the schematic for the binary programmable current mirror 24 is depicted. In this depicted implementation, the circuit layout includes four switches $S_0$ through $S_3$ which serve to program the transfer ratio $I_{OUT}/I_{IN}$ of the current mirror 24. Therefore, the circuit is a four-bit binary programmable unit. However, the circuit can be alternatively configured to have any reasonable number of a plurality of bits.

In order to divide the input current $I_{IN}$ into four identical currents $I_{IN}/4$, transistors $Q_0$ through $Q_3$ and resistors $R_0$ through $R_3$ are provided with identical, or nearly-identical characteristics. Transistors $Q_0$ through $Q_3$ operate as current sources. The four identical currents are then passed to diodes $D_0$ through $D_3$, or else they are diverted to ground depending on the status of switches $S_0$ through $S_3$. For example, when switch $S_3$ is open, the current $I_3$ is equal to $I_{In}/4$. For the case where switch $S_3$ is closed, $I_3$ equals zero. Therefore, the voltage Vx is essentially a programmable voltage that is dependent on the status of the switches $S_0$ through $S_3$, as well as the value of $I_{In}$. For conditions where the switches $S_0$ through $S_3$ are non-ideal with non-zero "on" resistances, the transfer function of the current mirror 24 will not be affected appreciably as long as the product of $I_{In}/4 * R_{ON}$ does not approach the forward voltage drop of the isolation diodes $D_0$ through $D_3$. As a result, costs can be reduced significantly because it is only necessary to approximately obtain an ideal switch, such that only nearly ideal switches are necessary which can be implemented in a less-costly manner.

Alternatively, the switches $S_0$ through $S_3$ can be constructed from transistors controlled by accompanying circuitry. This would not be possible if the design required-ideal switches because a circuit design which is sensitive to the "on" resistance of the switches will be adversely affected. However, with the current mirror 24 of this invention, the significant "on" resistance of the transistors will not produce an adverse effect, thereby allowing for practical use of the transistor and accompanying circuitry implementation.

In operation, the currents $I_0$ through $I_3$ are fed to a conventional R-2R ladder network 40 which gives each component a binary weighting at node Vx. Solving for Vx in terms of the currents $I_0$ through $I_3$ will yield the following expression:

$$Vx=2I_3R_L/3+I_2R_L/3+I_1R_L/6+I_0R_L/12 \quad (1).$$

It is then possible to express each of the currents $I_0$ through $I_3$ in the general form ($I_{IN}/4*B_N$) where $B_N$ represents the status of each respective switch (N), and will have a value of unity, or one, if the switch is open, and will have a value of zero if the switch is closed. Therefore, the expression for Vx may be rewritten as:

$$Vx=2R_LI_{IN}/3*(B_3/2+B_2/4+B_1/8+B_0/16) \quad (2)$$

Additionally, operational amplifier $A_1$, resistor $R_X$, and transistors $Q_{24}$ and $Q_{25}$ to form a voltage to current converter circuit operable to drive the output current where:

$$I_{OUT}=Vx/Rx \quad (3)$$

substituting equation 2 for Vx yields:

$$I_{OUT}=I_{IN}*(R_L/R_X)/3*(B_3/2+B_2/4+B_1/8+B_0/16) \quad (4)$$

Observation of equation 4 readily reveals that the transfer ratio of $I_{OUT}$ to $I_{IN}$ may be readily programmed to any of 16 values ranging generally from zero to a value of $(R_L/R_X)/3*(15/16)$ in incremental steps of $(R_L/R_X)/3*(1/16)$ as directed by the binary code implemented via the status of switches $S_3$ through $S_0$. It becomes very easy to set the maximum value of the transfer ratio by appropriately choosing the ratio of $R_L/R_X$.

Alternatively, the above described technique may be easily extended to provide any reasonable number of bits in order to increase the number of increments, thereby decreasing their incremental size in order to achieve a higher resolution. The general form for the resulting transfer function for n-bits of programmability would be as follows:

$$I_{OUT}=(I_{IN}/n)*(R_L/R_X)*4/3*(B_{(n-1)}/2+B_{(n-2)}/4+\ldots+B_1/2^{n-1}+B_0 2^n) \quad (5)$$

As a result, a current mirror is disclosed that is suitable for implementation on integrated circuitry, and preferably monolithic chip designs, having a variable $I_{OUT}/I_{IN}$ transfer ratio that is programmable based on the status of a plurality of binary weighted switches. The resulting circuit is easily designed to be insensitive to the "on" characteristics of the switches, wherein the switches may also be alternatively implemented via transistors controlled by accompanying circuitry. Another key feature is provided since the design is implemented utilizing smaller resistors and transistors having similar values which can be readily trimmed and more easily matched while not exponentially increasing the required size of a circuit layout as the number of bits are increased. This allows for the closer proximity placement for matching purposes between components for mirrors with many bits programmability, and therefore provides better circuit performance over environmental variations, and allows for use of a much smaller die size during fabrication.

Additionally, a binary means of switching in or out the current source is provided. Essentially, with the R-2R ladder, a series of these current sources are first generated and then weighted with the ladder to provide for a binary adjustable, binary weighted, current source.

Furthermore, output current $I_{OUT}$ can be easily adjusted entirely independent of the input current $I_{IN}$. In order to adjust this ratio, it is only necessary that one resistor be changed. For example, as shown in FIG. 2, a resistor Rx need only be changed. However, for alternative prior art designs where the input current can not be changed for a particular design, and when the output current requirements $I_{OUT}$ change, all of the binary weighted area ratios of the transistors must be changed. The benefits of implementing the current mirror of this invention are therefor ready apparent.

While this invention has been disclosed in connection with a particular example thereof, no limitation is intended thereby except as defined in the following claims. This is because a skilled practitioner recognizes that other modifications can be made without departing from the spirit of this invention after studying the specification and drawings.

What is claimed is:

1. A programmable current mirror circuit comprising:

an input terminal configured for receiving an analog input current;

an input current divider circuit configured to receive the input current and divide the input current into a plurality of fractional source currents each being substantially identical;

a binary weighting circuit configured to receive one or more of the fractional source currents and provide an associated weighted voltage;

a plurality of switches each configured to ground out one of the fractional source currents when enabled so as to prevent current flow to said binary weighting circuit from said respective fractional source current;

a plurality of forward current flow circuit means each configured to prevent reverse current flow from said binary weighting circuit to said switches and coupling the fractional source currents to said binary weighting circuit for imparting a binary weighting thereto; and voltage to current converting means configured to receive the binary weighting voltage, said converting circuit means converting said binary weighted voltage to a weighted output current proportional to the binary weighted voltage.

2. The programmable current mirror circuit as defined in claim 1 wherein said input current divider circuit comprises a plurality of transistors, each with a first and second terminal defining a current path and a control terminal, said first terminal connected to a resistor that is further connected to said circuit input terminal, said second terminal being connected to a respective reference terminal providing the corresponding fractionally source current, and said control terminal being connected to a voltage bias terminal.

3. The programmable current mirror circuit as defined in claim 1 wherein said input current divider circuit comprises an array of four substantially identical resistors and four substantially identical transistors configured so as to provide four references, each provided from one of the transistor second terminals as one of the fractional source currents.

4. The programmable current mirror circuit as defined in claim 1 wherein each of said switches includes a first and a second terminal defining an interruptible current path, said first terminal connected to a respective one of said fractional source currents, and said second terminal connected to a ground, said switch electrically grounding-out current flow from the respective source current when said switch is enabled so as to provide the interruptible current path.

5. The programmable current mirror circuit as defined in claim 1 wherein said plurality of forward current flow circuit means comprise a plurality of forward current flow diodes configured such that one of said diodes receives a respective fractional source current.

6. The programmable current mirror circuit as defined in claim 1 wherein said binary weighting circuit comprises an R-2R ladder network configured to receive current output from an associated terminal from said forward current flow circuit means so as to provide the associated binary weighted voltage at a voltage output terminal.

7. The programmable current mirror circuit as defined in claim 1 wherein said voltage to current converting circuit means comprises:

an operational amplifier configured to receive the weighted voltage from said binary weighting circuit at a positive input terminal and connected at an output to a transistor;

a resistor serially connected to the transistor, and a current output terminal connected with said transistor, wherein said voltage to current converting circuit means drive an upward current at said current output terminal in relation to an input current at said input terminal as determined by a binary code controlling the status of said plurality of switches.

8. The programmable current mirror circuit as defined in claim 7 wherein said transistor comprises a Darlington transistor.

9. A programmable current mirror circuit comprising:

an input terminal for receiving an input current;

a current divider network configured to receive the input current from said input terminal and divide the input current into four substantially identical fractional source currents each divided at a respective network terminal;

a binary weighting circuit configured to receive the fractional source currents from said current divider network;

a plurality of switches each configured to ground out one of the fractional input currents when enabled so as to shunt current flow to said binary weighting circuit via a respective one of said network terminals;

forward current flow circuit means configured for ensuring a forward flow of current from said input current divider circuit to said binary weighting circuit and for preventing reverse current flow from the binary weighting circuit to said switches; and voltage to current converting circuit means configured to receive a binary weighted voltage from said binary weighting circuit, said voltage to current converting circuit means operable to convert the binary weighted voltage to a weighted output current proportional to such binary weighted voltage.

10. The programmable current mirror circuit as defined in claim 9 wherein said current divider network comprises the four current sources configured to receive the input current and provide a plurality of substantially identical fractional input currents.

11. The programmable current mirror circuit as defined in claim 9 wherein said binary weighting circuit comprises an R-2R ladder network configured to receive current output from an associated terminal from said forward current flow circuit means so as to provide the associated binary weighted voltage at a voltage output terminal.

12. A method of configuring an output current in relation to a specific input current, said method comprising the steps of:

receiving an input current;

dividing the input current into a plurality of substantially identical fractional currents;

configuring a binary weighting circuit to receive anywhere from none to all of said fractional currents via current transmission controlled by a plurality of switches;

grounding out any of said fractional source currents so as to prevent current flow to said binary weighting circuit;

weighting, with said binary weighting circuit, the fractional source currents received thereby to provide associated binary weighted outputs and outputting a voltage dependent upon the binary weighted outputs received via said fractional currents;

converting such voltage into an output current; and outputting such output current to an output terminal.

13. The method of claim 12 wherein the step of configuring the binary weighting circuit to receive said fractional currents further comprises the step of disabling a respective switch so as to interrupt a shunt to ground and provide a source of current therefrom.

14. A programmable current mirror circuit comprising:

an input for receiving an analog input current;

a current divider circuit configured to receive the input current and divide the input current into a plurality of fractional source currents;

a binary weighting circuit configured to receive one or more of the fractional source currents and provide associated weighted voltages;

a plurality of switches each configured to ground out one of the source currents when enabled so as to prevent current flow to said binary weighting circuit from the respective current source; and voltage to current converting means configured to receive the binary weighting voltage and convert said binary weighted voltage to a weighted output current proportional to the binary weighted voltage.

* * * * *